US005996570A

United States Patent [19]

Legate

[11] Patent Number: 5,996,570

[45] Date of Patent: Dec. 7, 1999

[54] ARCHERY BOW STABILIZER

[76] Inventor: Boyd B. Legate, 13146 157th Ct. N., Jupiter, Fla. 33478

[21] Appl. No.: 09/074,733

[22] Filed: May 8, 1998

[51] Int. Cl.[6] ..... F41B 5/20

[52] U.S. Cl. ..... 124/89; 267/136

[58] Field of Search ..... 124/89; 188/378, 188/380; 267/136

[56] References Cited

U.S. PATENT DOCUMENTS

| | | | |
|---|---|---|---|
| 3,342,172 | 9/1967 | Sanders | 124/89 X |
| 4,893,606 | 1/1990 | Sisko | 124/89 |
| 4,982,719 | 1/1991 | Haggard et al. | 124/89 |
| 4,986,018 | 1/1991 | McDonald | 124/89 X |
| 5,016,602 | 5/1991 | Mizek | 124/89 |
| 5,370,104 | 12/1994 | Neie | 124/89 |
| 5,595,169 | 1/1997 | Brown | 124/89 |

*Primary Examiner*—John A. Ricci
*Attorney, Agent, or Firm*—McHale & Slavin PA

[57] ABSTRACT

A damped archery bow stabilizer includes a primary tube having a hollow interior. A shock absorber assembly is disposed within of the primary tube hollow interior. The shock absorber assembly employs a shock absorber housing, a damping construction, and damping fluid. The shock absorber housing includes a hollow sleeve bounded by a first endcap and a second endcap. The damping construction is disposed within the shock absorber housing and includes a vibration absorbing mass held in place by biasing springs. The biasing springs cooperate with the damping fluid to limit the motion of the vibration absorbing mass. The damping fluid has a relatively temperature-independent viscosity. In an alternate embodiment, the hollow interior of the primary tube includes vibration-absorption material disposed between the inside surface of the primary tube and the outside surface of the shock absorber assembly.

20 Claims, 3 Drawing Sheets

ARCHERY BOW STABILIZER

FIELD OF THE INVENTION

This invention is directed to archery bow stabilizers and, in particular, to a stabilizer having a damped shock absorber assembly mounted within an elongated primary rod.

BACKGROUND OF THE INVENTION

The sport of archery is an ancient pastime in which an archery bow is used to project arrows at selected targets. An archer's success is based, in large part, upon the ability to master three main tasks: accurately judging distances, keeping a bow steady during a given shot, and managing muscle fatigue.

Archers consider target distance when assessing the likely affects of gravity and drag while aiming at a target. Because arrows tend to lose altitude during flight, many archers fire arrows along an arced path. Proper assessment of target distances helps an archer calculate the arc required to deliver an arrow to a chosen target.

Similarly, an archer must be able to keep a bow steady while firing an arrow. If the bow wavers during a shot, the accuracy of the shot will be affected. Some archers find bow placement to be so critical that they time shots in deference to the cadence of their breathing.

Since bow positioning is a critical part of an archer's success, dexterity loss as a result of muscle fatigue can be a source of poor results. Archers typically use the same group of muscles from shot to shot. As a result, the muscles used may tire quickly. Exposure to excess vibration may cause the relevant muscles to tire at an accelerated rate, increasing the likelihood of injury and reducing the likelihood for accuracy.

Distance-judging ability, bow steadying capacity, and resistance to muscle fatigue may be developed through practice and rigorous training. However, as with many sports, specialized equipment has been developed to help archers with various aspects of the sport. For example, sighting devices help many archers determine the correct arrow path for targets of varying distance. Additionally, braces and balancing bars have been created to help archers steady a bow during a given shot. Furthermore, damping devices attempt to ease fatigue by reducing the amount of vibration transmitted to muscles of bow-supporting hands and arms.

Although the known equipment provides a certain amount of assistance, its use often brings liabilities. Damping devices, in particular, may cause more trouble than they alleviate. Known damping devices typically attempt to absorb vibration before it is transferred to an archer's muscles. The success of the damping device is a function of vibration absorbing qualities of the device.

Early damping devices attached rigid masses to the body of an archery bow, with the extra mass absorbing a portion of the vibration produced when an arrow was fired. However, the success of these rigid mass dampers relied upon mass size, with larger masses absorbing more vibration. Unfortunately, past a certain point, extra mass is cumbersome. Bows equipped with too-large masses ironically create muscle fatigue not from vibration transmittal, but from increased weight.

Other known damping devices seek to absorb vibrations through use of fluids or elastomers. Although these types of devices provide increased damping capacity with only moderate weight increases, their performance is largely environment-dependent. The performance properties of known damping devices varies with temperature. As a result, known damping devices behave one way in cold weather and differently in hot weather. In cold weather, the devices become rigid and, due to their relatively-low mass designs, exhibit low vibration absorbing capacities. In hot weather, these devices become increasingly lossy and, again, display a diminished ability to absorb vibration. Furthermore, while the damping capacity of known damping devices of this type is acceptable at moderate temperatures, the unpredictable nature of these devices makes them difficult to use. Hydraulic devices, for example, operate differently in hot weather than in cold weather.

Thus, what is needed is a damped archery bow stabilizer that includes advantages of the known devices, while addressing the shortcomings they exhibit. The stabilizer should make a bow comfortable and accurate to use. The stabilizer should also exhibit a high vibration damping capacity without unduly increasing the weight of the bow. The stabilizer should also provide consistent performance across a wide range of temperatures without requiring adjustment or compensation before use.

SUMMARY OF THE INVENTION

The instant invention is a damped archery bow stabilizer including features that promote consistent performance in a wide range of temperatures. The stabilizer includes a primary tube having a hollow interior region. A shock absorber assembly is disposed within the primary tube hollow interior region, mounted at a first end of the tube. The shock absorber assembly includes three main components: a shock absorber housing, a damping construction, and damping fluid.

The shock absorber housing is, in essence, a hollow sleeve bounded by a removable first endcap and an opposite second endcap. The damping construction includes a vibration absorbing mass and a pair of biasing springs that position the vibration absorbing mass within the shock absorber housing. Damping fluid surrounds the biasing springs and vibration absorbing mass, filling the shock absorber housing. The vibration absorbing mass will move within the shock absorber housing, but the damping fluid and biasing springs cooperate to prevent erratic motion of the vibration absorbing mass. The damping fluid is a mixture including ethylene glycol and a rust inhibitor. As a result, the damping fluid arrests corrosion, has a temperature-tolerant viscosity, and assimilates hydraulic fluid.

An attachment post extends from the first endcap and facilitates threaded attachment of the stabilizer to the front of an archery bow. During use, vibrations in the archery bow body are transferred through the attachment post to the stabilizer and the shock absorber assembly contained therein. The vibrations eventually reach the vibration absorbing counterweight or "mass", causing the vibration absorbing mass to move within the shock absorber housing. The biasing springs and damping fluid resist the vibration absorbing mass motion and bring the vibration absorbing mass back to equilibrium. As the vibration absorbing mass returns to rest, the energy transferred from the bow main body is dissipated. In an alternate embodiment, the primary tube includes vibration-absorbing material that absorbs energy not dissipated by shock absorber assembly.

Thus, it is an object of the present invention to provide a damped archery bow stabilizer that reduces muscle fatigue by absorbing vibrations produced when the bow is used.

An additional object of the present invention is to provide a damped archery bow stabilizer that effectively reduces large amounts of vibration without adding an unacceptable amount of weight.

Still a further object of the present invention is to provide a damped archery bow stabilizer that provides consistent performance in a wide range of temperatures.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
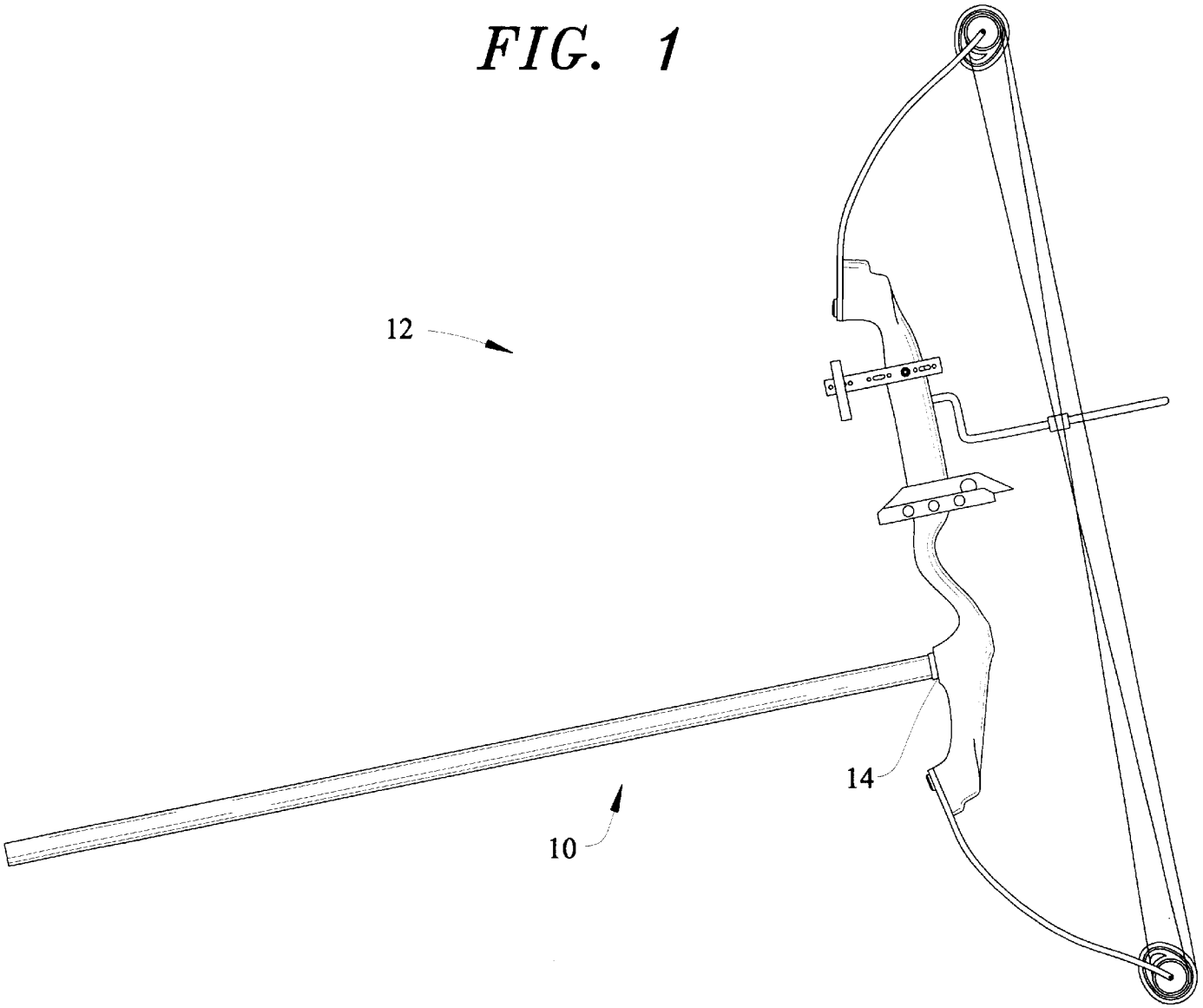
FIG. 1 is a pictorial view of the stabilizer of the present invention shown in use on an archery bow.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
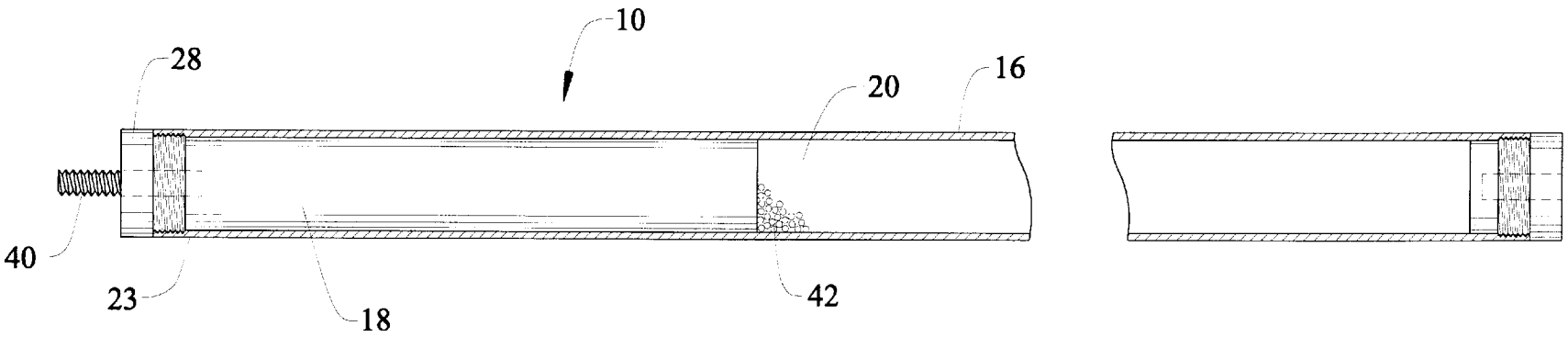
FIG. 2 is a cross section view of the stabilizer shown in FIG. 1.

Now with reference to FIG. 1, a pictorial view of an archery bow stabilizer 10 according to the present invention is shown in use on an archery bow 12. As seen in FIG. 1, the stabilizer 10 extends from a front surface 14 of the bow 12. With reference to FIG. 2, and by way of overview, the stabilizer 10 of the present invention includes a primary tube 16 and a shock absorber assembly 18 disposed inside a hollow interior region 20 of the primary tube. The details of the stabilizer 10 will be discussed below.

Figure 3:
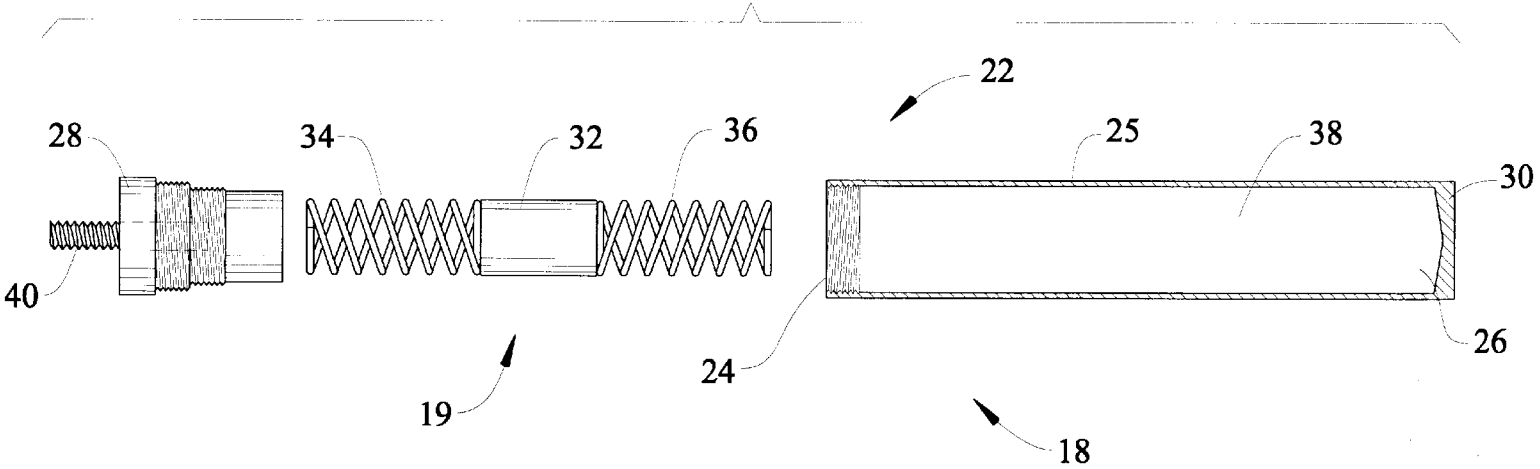
FIG. 3 is a cross section exploded view of the shock absorber assembly shown in FIG. 2.

With continued reference to FIG. 2, and with additional reference to FIG. 3, the shock absorber assembly 18 includes three main components: a shock absorber housing 22, a damping construction 19, and damping fluid 38. The shock absorber assembly 18 is disposed inside a first end 23 of the primary tube 16.

The shock absorber housing 22 is essentially a hollow sleeve 25 that has an open first end 24 and a closed second end 26. The sleeve first end 24 is threaded to accommodate a removable first endcap 28. The sleeve second end 26 is bounded by a second endcap 30 that is formed integral with the sleeve 25.

The damping construction 19 is comprised of a vibration absorbing mass 32 and a pair of biasing springs 34,36. The vibration absorbing mass 32 is held in place inside the shock absorber housing 22 by the biasing springs 34,36. More specifically, a first biasing spring 34 extends between the first endcap 28 and the vibration absorbing mass 32, while a second biasing spring 36 extends between the second endcap 30 and the vibration absorbing mass 32. The vibration absorbing mass 32 has an outer diameter that approximates the inner diameter of the housing sleeve 25. The biasing springs 34,36 straddle the vibration absorbing mass 32 and abut the endcaps 28,30.

The biasing springs 34,36 are sized and positioned to cooperatively direct the vibration absorbing mass 32 into a predetermined location within the housing sleeve 25. In the preferred embodiment, the spring constant of the biasing springs 34,36 is sufficient maintain the vibration absorbing mass 32 approximately halfway between the endcaps 28,30 when the first endcap 28 is threaded into place.

In addition to the vibration absorbing mass 32 and the biasing springs 34,36, the shock absorber housing 22 also contains damping fluid 38. In the preferred embodiment, the damping fluid 38 is a mixture of ethylene glycol and a rust inhibitor. One suitable rust inhibitor is available under the trademark NALCOOL; other rust inhibitors may be used, however. The ratio of ethylene glycol to rust inhibitor in the damping fluid 38 is approximately one gallon of ethylene glycol for each pint of rust inhibitor. With this ratio, the damping fluid 38 is tolerant of temperature fluxuation and has a relatively-consistent viscosity across a wide range of temperatures. The damping fluid 38 also inhibits corrosion. If the corrosion inhibiting qualities are not desired, the damping fluid 38 may be made without the rust inhibitor.

Although the biasing springs 34,36 position the vibration absorbing mass 32 within the shock absorber housing 22, the vibration absorbing mass is not rigidly fixed. Instead, the biasing springs 34,36 and damping fluid 38 cooperate to allow controlled motion of the vibration absorbing mass 32 within the housing 22.

With additional reference again to FIG. 1, the archery bow stabilizer 10 is attached to the archery bow 12 by an attachment post 40 that extends orthogonally from the shock absorber housing first endcap 28. The attachment post 40 is threaded, allowing the stabilizer 10 to be screwed into a threaded attachment bore, not shown, that penetrates the archery bow front surface 14. With this arrangement, vibrations within the bow 12 are transferred, via the attachment post 40, to the bow stabilizer 10 and the shock absorber assembly 18 contained therein.

During use of the bow 12, energy is transferred, via the attachment post 40, from the bow main body into the shock absorber assembly 18. More specifically, the energy passes through the endcaps 28,30, along the biasing springs 34,36, and into the vibration absorbing mass 32. This transfer of energy causes the vibration absorbing mass 32 to move within the shock absorber housing 22.

The damping fluid 38 and biasing springs 34,36, resist the vibration absorbing mass 32 motion and bring the vibration absorbing mass 32 to rest. As the vibration absorbing mass 32 returns to equilibrium, energy transferred from the main body of the bow 12 is dissipated. Remaining energy not dissipated by the shock absorber assembly 18 is absorbed by the primary tube 16, where it is dissipated along the length of the tube. Because the shock absorber assembly 18 and primary tube 16 dissipate so much energy, an archery bow 12 equipped with the present stabilizer 10 transfers very little vibration to an individual's bow-supporting hand and arm during use. This advantageously reduces muscle fatigue, makes the bow 12 comfortable to use, and increases accuracy. Furthermore, the above-described temperature tolerance of the damping fluid ensures that the bow 12 remains comfortable and accurate in a wide variety of temperatures. Accordingly, a single bow 12 equipped with the present stabilizer 10 may be used with equal ease and success in a variety of locations and during all seasons.

Figure 4:
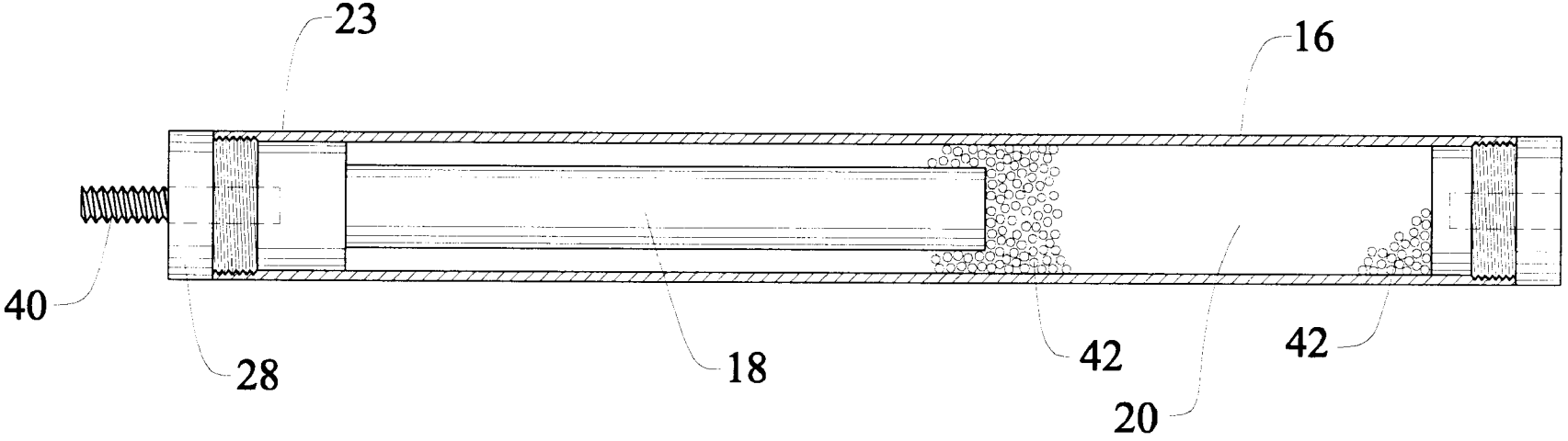
FIG. 4 is a cross section view of an alternate embodiment of the stabilizer of the present invention.

In an alternate embodiment the damping qualities of the primary tube 16, itself, are also improved. As seen in FIGS. 3 and 4, the hollow interior region 20 of the primary tube 16 may be filled with a quantity of vibration-absorbing material 42. The appropriate quantity of material 42 required is a function of the primary tube 16 interior volume. However, enough material 42 should be used so that the material substantially fills the space between the outside surface of the shock absorber assembly 18 and the inside surface of tube interior region 20.

One suitable vibration-absorbing material 42 is granular amorphous silicate, such as that manufactured by the 3M company, sold under the trademarks "MICRO BALLOONS," "GLASS BUBBLES," and "ZERO-SPHERES." Other types of absorbing material 42 may be used without detriment. For example, silica alumina ceramic, such as that sold under the trademark "Z-LIGHT" will also suffice. Alternatively, alkali alumina silicate such as that sold under the trademark "ZSPHEAN," soda lime borosilicate glass, borosilicate, and the like are also sufficient.

With the primary tube 16 filled with absorbing material 42, the stabilizer 10 will dissipate an increased level of energy. Additionally, like the damping fluid 38 found in the shock absorber assembly 18, the above-described absorbing material 42 has a consistency that is relatively temperature independent. As a result, the damping characteristics of the filled primary tube 16 do not fluxuate noticeably from one environment to another. A primary tube 16 filled as described above will complement the shock absorber assembly 18, providing a stabilizer 10 that promotes comfortable and accurate archery bow 12 use, while being relatively unaffected by environmental temperature variations, and without adding undue amounts of weight.

As a result, an archery bow 12 equipped with the present stabilizer 10 is comfortable to use and accurate to shoot, even when used for an extended period of time. Additionally, by including unique, temperature-tolerant features, the stabilizer 10 provides consistent performance in a wide range of temperatures.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. An archery bow stabilizer comprising:

a primary tube having a hollow interior region, said primary tube being characterized by a threaded first end;

a shock absorber assembly disposed within said hollow interior region; said shock absorber assembly including a shock absorber housing, a damping construction, and a vibration-absorbing-effective amount of damping fluid disposed within said housing; said shock absorber housing defined as a hollow sleeve bounded by a removable first endcap and an opposite second endcap, said first endcap having a threaded surface constructed and arranged to engage said primary tube threaded first end; said damping construction being disposed within said hollow sleeve, said damping construction including a vibration absorbing mass positioned inside said hollow sleeve by a first biasing spring and a second biasing spring, said first biasing spring extending between said vibration absorbing mass and said first endcap and said second biasing spring extending between said vibration absorbing mass and said second endcap; and an attachment post having a first end and a second end, said attachment post being constructed and arranged for releasable attachment of said attachment post first end directly into said shock absorber assembly first endcap and said attachment post second end directly into said bow;

whereby said shock absorbing assembly is rigidly connected to said attachment post via said shock absorber assembly first endcap and said primary tube is removably attached to said first end cap threaded surface, thereby allowing removal of said primary tube for filling or use with said shock absorbing assembly only.

2. The archery bow stabilizer of claim 1, wherein said damping fluid is ethylene glycol.

3. The archery bow stabilizer of claim 2, wherein said damping fluid includes a rust inhibitor.

4. The archery bow stabilizer of claim 1, wherein said biasing springs are sized and positioned to cooperatively direct said vibration absorbing mass into a damping effective location within said sleeve.

5. The archery bow stabilizer of claim 4, wherein said damping effective location is approximately halfway between said housing first endcap and said housing second endcap.

6. The archery bow stabilizer of claim 1, wherein said first endcap is adjacent to a first end of said primary tube.

7. The archery bow stabilizer of claim 1 wherein said second endcap is formed integral with said shock absorber housing.

8. An archery bow stabilizer comprising:

a primary tube having a hollow interior region;

a shock absorber assembly disposed within said hollow interior region; said shock absorber assembly including a shock absorber housing, a damping construction, and a vibration-absorbing-effective amount of damping fluid disposed within said housing; said shock absorber housing defined as a hollow sleeve bounded by a removable first endcap and an opposite second endcap; said damping construction being disposed within said hollow sleeve, said damping construction including a vibration absorbing mass positioned inside said hollow sleeve by a first biasing spring and a second biasing spring, said first biasing spring extending between said vibration absorbing mass and said first endcap and said second biasing spring extending between said vibration absorbing mass and said second endcap; and an attachment post having a first end and a second end, said attachment post being constructed and arranged for releasable attachment of said attachment post first end to said first endcap and said attachment post second end to said bow; and vibration-absorbing material disposed between an inside surface of said primary tube interior region and an outside surface of said shock absorber assembly.

9. The archery bow stabilizer of claim 8, wherein said vibration-absorbing material is granular amorphous silicate.

10. The archery bow stabilizer of claim 8, wherein said vibration-absorbing material is silica alumina ceramic.

11. The archery bow stabilizer of claim 8, wherein said vibration-absorbing material is alkali alumina silicate.

12. An archery bow stabilizer comprising:

a primary tube having a hollow interior region;

a shock absorber assembly disposed within said hollow interior region; said shock absorber assembly including a shock absorber housing, a damping construction disposed within said shock absorber housing, and a vibration absorbing amount of damping fluid disposed within said shock absorber housing, said damping fluid containing ethylene glycol;

a damping effective amount of vibration-absorbing material disposed between an inside surface of said primary tube interior region and an outside surface of said shock absorber assembly; and an attachment post having a first end and a second end, said attachment post being constructed and arranged for releasable attachment of said attachment post first end to said shock absorber assembly and said attachment post second end to said bow.

13. The archery bow stabilizer of claim 12, wherein said shock absorber housing is defined as a hollow sleeve bounded by a removable first endcap and an opposite second endcap.

14. The archery bow stabilizer of claim 13, wherein said damping construction is defined as a vibration absorbing mass positioned inside said hollow sleeve by a first biasing spring and a second biasing spring, said first biasing spring extending between said vibration absorbing mass and said first endcap and said second biasing spring extending between said vibration absorbing mass and said second endcap.

15. The archery bow stabilizer of claim 14, wherein said damping fluid further includes a rust inhibitor.

16. The archery bow stabilizer of claim 15 wherein said biasing springs are sized and positioned to cooperatively direct said vibration absorbing mass approximately halfway between said housing first endcap and said housing second endcap.

17. The archery bow stabilizer of claim 16, wherein said vibration-absorbing material is granular amorphous silicate.

18. The archery bow stabilizer of claim 16, wherein said vibration-absorbing material is alumina silicate.

19. The archery bow stabilizer of claim 16, wherein said shock absorber housing is formed of aluminum.

20. The archery bow stabilizer of claim 16, wherein said primary tube is formed of aluminum.

* * * * *